US006739956B2

(12) United States Patent
Noestheden

(10) Patent No.: US 6,739,956 B2
(45) Date of Patent: May 25, 2004

(54) APPARATUS FOR CLEANING ENGINE BLOCK PASSAGES

(75) Inventor: Andrew Noestheden, Tecumseh (CA)

(73) Assignee: Valiant Corporation, Windsor (CA)

( * ) Notice: Subject to any disclaimer, the term of this patent is extended or adjusted under 35 U.S.C. 154(b) by 99 days.

(21) Appl. No.: 10/021,188

(22) Filed: Oct. 30, 2001

(65) Prior Publication Data

US 2003/0083002 A1 May 1, 2003

(51) Int. Cl.[7] ..... B24C 3/32

(52) U.S. Cl. ..... 451/76; 451/39; 451/61; 451/87; 451/91

(58) Field of Search ..... 451/38, 39, 40, 451/51, 60, 61, 76, 87, 91, 446; 34/104, 437; 15/304, 395, 406, 407, 415.1, 416; 134/7, 8, 21, 22.11

(56) References Cited

U.S. PATENT DOCUMENTS 2,627,149 A * 2/1953 MacCracken ..... 451/38
2,896,645 A * 7/1959 Iwasaki ..... 134/111
5,161,336 A * 11/1992 Ritt et al. ..... 451/87
5,232,513 A * 8/1993 Suratt et al. ..... 134/21
5,419,352 A * 5/1995 Johnson ..... 134/102.1

* cited by examiner

*Primary Examiner*—Timothy V. Eley
(74) *Attorney, Agent, or Firm*—Gifford, Krass, Groh, Sprinkle, Anderson & Citkowski, P.C.

(57) ABSTRACT

An apparatus for cleaning a passage in an engine block, such as the oil galley and oil galley legs, in which the passage includes an inlet and an outlet end. The apparatus includes a fixture having an interior passageway with an opening. The fixture is dimensioned to abut against the engine block so that the opening in the fixture registers with the engine block passage outlet. An air induction source is then fluidly connected to the fixture passageway so that, upon actuation of the air induction source, the air induction source inducts air through the engine block passage, through the fixture opening, and through the fixture passageway. A feeder containing abrasive shot is then coupled to the engine block passage inlet so that, upon actuation of the air induction source, the abrasive shot is inducted through the engine block passage and into the fixture passageway.

7 Claims, 1 Drawing Sheet

APPARATUS FOR CLEANING ENGINE BLOCK PASSAGES

BACKGROUND OF THE INVENTION

I. Field of the Invention

The present invention relates generally to a device for cleaning a passage in an engine block.

II. Description of the Prior Art

Engine blocks of the type used in internal combustion engines are typically manufactured by initially forming a casting for the engine block and thereafter machining the casting. In some instances, especially for aluminum engine blocks, the engine block includes internal passageways which are formed during the casting operation. The oil galley and the galley legs of an aluminum engine block for lubricating the main bearings of the engine are typically formed by casting.

When the internal passageways are formed by casting, however, refractory sand oftentimes becomes embedded within the walls forming the passageway. Such refractory sand, furthermore, can severely damage the engine and/or the engine bearings if the sand dislodges during operation of the engine. Consequently, it is necessary to thoroughly clean the internal passageways of the engine block following the casting operation.

One previously known method for cleaning the internal passageways of the engine block has been to blow abrasive pellets through the engine block passageway in an effort to clean or dislodge any sand that may be embedded within the passageway walls. Although the abrasive pellets have taken many forms, in at least one previously known form, the abrasive pellet is elongated and cylindrical in shape with points at each end.

This previously known method for cleaning the internal engine block passageways, however, has not proven wholly satisfactory in operation. A primary disadvantage of this previously known method is that, although the abrasive pellets are initially introduced into the engine block passageway at a high velocity, such pellets rapidly decelerate thereby diminishing their cleaning efficacy. As such, this previously known method for cleaning the internal passageways of an engine block oftentimes leaves sand impregnated in the walls of the engine block passageway. After prolonged operation of the engine, such sand oftentimes dislodges from the engine block passageways and disadvantageously damages the engine components. Indeed, in some cases, the shot may become wedged in the passageway and, if subsequently dislodged, seriously damage the engine.

SUMMARY OF THE PRESENT INVENTION

The present invention provides both an apparatus and a method for cleaning the internal passageways of an engine block which overcomes all of the above-mentioned disadvantages of the previously known devices.

In brief, the apparatus of the present invention comprises a fixture having an interior fluid passageway and at least one opening which fluidly connects the fixture passageway exteriorly of the fixture. The fixture, furthermore, is dimensioned to register with the outlet from the engine block passageway when the engine block is positioned against the fixture.

An air induction source is then fluidly connected with the fixture passageway so that, upon actuation, the air induction source inducts air through the engine block passage, through the fixture opening, through the fixture passageway and to the air induction source. This air induction source, furthermore, preferably comprises a fan which produces relatively high flow rates through the fixture and thus through the engine block passageway.

A feeder is connected so that the feeder includes an outlet which is open to the inlet of the engine block passage. This feeder is adapted to receive abrasive shot so that, upon actuation of the air induction source, the abrasive shot is entrained in the inducted airflow through the engine block passage. In doing so, the abrasive shot impacts against the walls of the passageway and effectively and completely removes any refractory sand which may be embedded within the walls of the engine block passage.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 2:
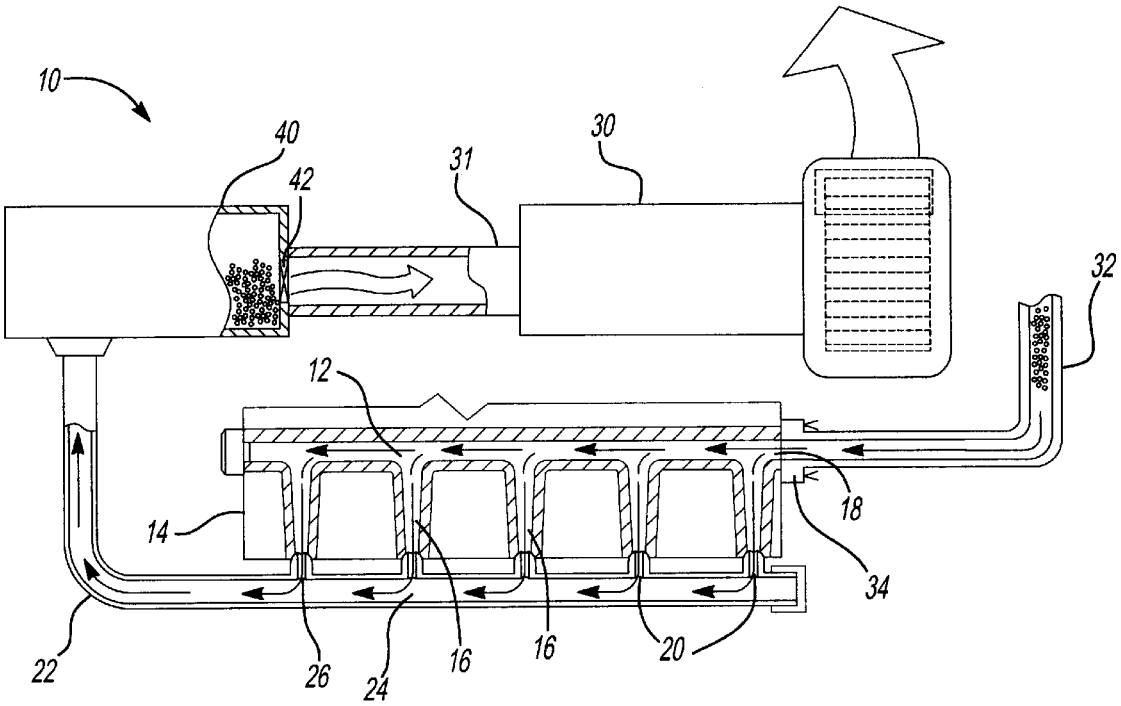
FIG. 2 is a side, partial sectional view illustrating the preferred embodiment of the present invention.

With reference to the drawing, an apparatus 10 for cleaning an interior passage 12 of an engine block 14 is shown. The internal passage 12 of the engine block 14 is illustrated in FIG. 2 as the oil galley for the engine block 14 and includes a plurality of oil galley legs 16, each of which is open to a main bearing for the engine block 14. Consequently, the engine block passage 12 includes an inlet end 18 into which oil is pumped during normal operation of the engine as well as a plurality of outlet ends 20, each of which are open to the main bearings for the engine block 14.

With reference now to FIG. 2, the apparatus 10 includes a fixture 22 having an interior fluid passageway 24. At least one, and more typically several openings 26 are formed through the fixture 22 so that the fixture openings 26 fluidly connect the fixture passageway 24 exteriorly of the fixture 22.

The fixture openings 26, furthermore, are dimensioned so that, with the engine block 14 positioned against the fixture 22 as illustrated in FIG. 2, one opening 26 registers with each outlet end 20 of the engine block passage 12. Consequently, all airflow from the inlet end 18 of the engine block passageway 12 to the outlet ends 20 also flows through the fixture openings 26 and into the fixture passageway 24.

An air induction source 30, such as a fan, has its inlet 31 fluidly connected with the fixture passageway 26 so that, upon actuation of the source 30, the source 30 inducts air through the fixture openings 26, through the fixture passageway 24 and to the air induction source 30. Consequently, assuming that the engine block 14 is positioned against the fixture 22 so that the openings 26 register with the outlet ends 20 of the passageway 12, upon actuation of the air induction source 30, air is also inducted through the passageway 12 from its inlet end 18 and to its outlet ends 20.

With reference now to FIG. 2, with the engine block 14 positioned against the fixture 22 so that the passage outlet ends 20 register with the fixture openings 26, a hopper 32 is positioned against the engine block 14 so that an outlet end 34 of the hopper 32 is open to the passage inlet end 18. The hopper 32 is then filled with an abrasive shot which, by gravity, flows through the hopper 32 and is entrained in the airflow through the passageway 12. This shot is preferably spherical in shape.

The flow of the abrasive shot through the engine passage 12 is at a speed sufficient so that the impact of the shot against the walls of the passageway 12 effectively dislodges any refractory sand which may be embedded within the walls of the engine block passage 12. Furthermore, since the abrasive shot is inducted through the passageway 12, rather than blown into the passageway 12 as in the previously known devices, the abrasive shot accelerates in speed from the passage inlet 18 to the passage outlet ends 20 of the passageway 12 thus retaining its cleaning efficacy during the entire flow of the abrasive shot through the passage 12.

Figure 1:
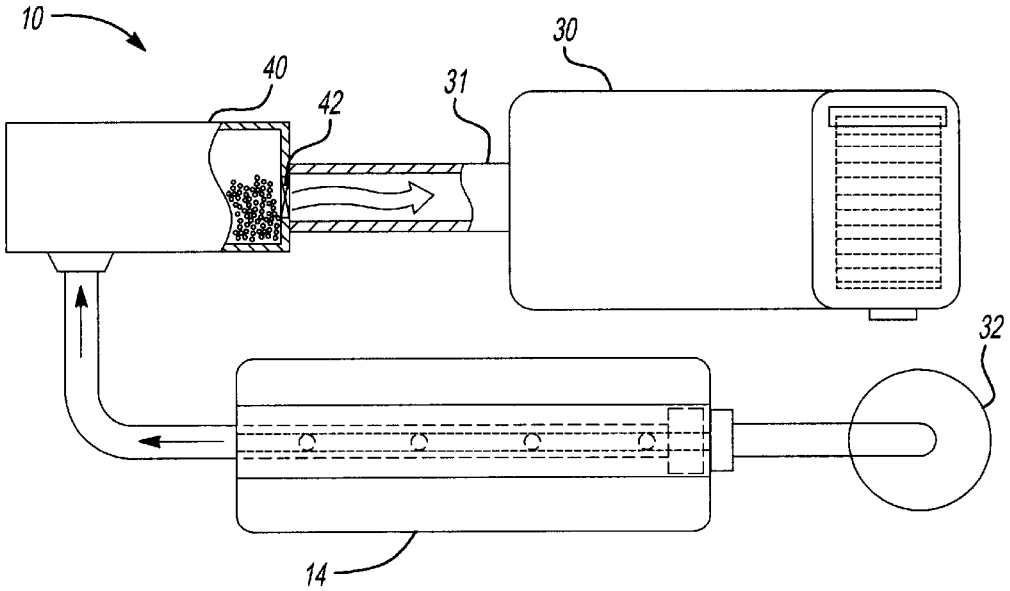
FIG. 1 is a top view illustrating a preferred embodiment of the present invention.

With reference now to FIGS. 1 and 2, a shot collection chamber 40 having a filter 42 disposed across the chamber 40 is fluidly positioned in series between the fixture passageway 24 and the inlet 31 of air induction source 30. Consequently, as shot is inducted into the fixture passageway 20, the shot enters into the collection chamber 40 while the filter 42 protects the air induction source 30 from the abrasive shot. The collection chamber 40 is emptied as required and the abrasive shot reused.

From the foregoing, it can be seen that the present invention provides a simple and yet highly effective apparatus and method for cleaning interior passages of an engine block. Perhaps most importantly, since the abrasive shot is inducted through the engine block passage rather than simply blown into the engine block passage as in the previously known devices, the speed of the abrasive shot through the engine block passage accelerates thus not only maintaining, but increasing the effective abrasive cleaning capability of the shot.

Having described my invention, however, many modifications thereto will become apparent to those skilled in the art to which it pertains without deviation from the spirit of the invention as defined by the scope of the appended claims.

I claim:

1. An apparatus for cleaning a passage in an engine block, the passage having an inlet and an outlet, said apparatus comprising:

a fixture dimensioned to abut against the engine block, said fixture having an interior passageway and an opening adapted to register with the engine block passage outlet, said opening being fluidly connected to said passageway, an air induction source fluidly connected with said fixture passageway so that, upon actuation, said air induction source draws air through the engine block passage, through said opening and through said fixture passageway, a feeder having an outlet open to said engine block passage inlet, said feeder adapted to receive abrasive shot so that, upon actuation of the air induction source, the abrasive shot is inducted through said engine block passage and into said fixture passageway, a shot collection chamber fluidly disposed in series with said fixture passageway upstream from said air induction source.

2. The invention as defined in claim 1 a comprising a filter fluidly disposed across said shot collection chamber.

3. The invention as defined in claim 1 wherein said air induction source comprises an air fan having an inlet fluidly connected to said fixture passageway.

4. The invention as defined in claim 1 wherein said feeder comprises a hopper having an open top and an outlet at its bottom.

5. The invention as defined in claim 1 wherein the engine block passage comprises an oil galley.

6. The invention as defined in claim 1 and comprising means for removing shot from the shot collection chamber.

7. The invention as defined in claim 1 wherein the shot is spherical in shape.

* * * * *